United States Patent [19]

Carter

[11] 4,115,179

[45] Sep. 19, 1978

[54] WRAP NECK LABEL MECHANISM

[75] Inventor: Sidney T. Carter, Shrewsbury, Mass.

[73] Assignee: A-T-O Inc., Cleveland, Ohio

[21] Appl. No.: 867,223

[22] Filed: Jan. 6, 1978

Related U.S. Application Data

[63] Continuation of Ser. No. 748,060, Dec. 6, 1976, abandoned.

[51] Int. Cl.[2] ..... B65C 9/28

[52] U.S. Cl. ..... 156/444; 156/475; 156/477 R; 156/487; 156/497; 156/556; 156/DIG. 38; 156/DIG. 42

[58] Field of Search ..... 156/443, 444, 475, 476, 156/477 R, 481, 486, 485, 487, 497, 556, 571, DIG. 12, DIG. 14, DIG. 25, DIG. 38, DIG. 27, DIG. 42

[56] References Cited

U.S. PATENT DOCUMENTS

| | | | |
|---|---|---|---|
| 2,506,963 | 5/1950 | Magnusson | 156/486 |
| 2,773,617 | 12/1956 | Weiss | 156/476 |
| 2,925,931 | 2/1960 | Carter | 156/481 |
| 3,001,660 | 9/1961 | Carter | 156/444 |
| 3,549,457 | 12/1970 | Carter | 156/476 |
| 3,707,417 | 12/1972 | Dullinger | 156/444 |
| 3,859,155 | 1/1975 | Dullinger | 156/444 |
| 3,970,508 | 7/1976 | Gossie | 156/477 R |

*Primary Examiner*—Jerome W. Massie
*Attorney, Agent, or Firm*—Dike, Bronstein, Roberts, Cushman & Pfund

[57] ABSTRACT

A labeling machine wherein there is a picker mechanism for tangentially attaching labels to the necks of bottles traveling along a predetermined path in predetermined spaced relation such that the planes of the tangentially attached labels are substantially parallel to the direction of travel, and longitudinally spaced means arranged along said path comprising jets which displace the ends of the labels transversely of the path and wipers which apply wiping forces to the ends to wrap the transversely displaced ends about the necks.

9 Claims, 16 Drawing Figures

WRAP NECK LABEL MECHANISM

This is a continuation of application Ser. No. 748,060 filed Dec. 6, 1976, now abandoned.

BACKGROUND OF THE INVENTION

For applying wraparound neck labels to bottles, it is desired after attaching the label to the near side of the bottle neck in relation to the attaching instrumentalities to wrap the ends around the sides of the necks to the far side and preferably to lap the ends. Air jets and brush-type wipers have been used to accomplish such neck wrapping operations. However, such apparatus is complicated by mechanism designed to rotate the bottles as they are traveling along after the labels are applied to present them to the wiping brushes and the latter apply the wiping forces for so short a time that the ends of the labels frequently curl away from the neck. The apparatus of this invention is designed to wrap the labels completely around the necks while the bottles are traveling along a predetermined path without manipulation of the bottles and to prolong the application of the wiping forces sufficiently long to prevent curling of the ends of the labels.

SUMMARY

Apparatus for applying labels to bottle necks comprising means for pressing labels into tangential engagement with the bottle necks of bottles traveling along a predetermined path and means beyond the place where the labels are pressed into tangential engagement with the necks for wrapping the ends of the labels about the necks. The wrapping means comprise at one side of the path of movement means for deflecting the ends of the label transversely of the path of movement and wiping means at the other side for movement at times along the path of movement in the direction of travel of the bottles to prolong the wiping action. There is means at the opposite side of the path of movement from the wiping means for engagement with the necks of the bottles while the bottles are being subjected to the wiping action of the wiping means to hold the bottles upright. The aforesaid neck-supporting means travels with the wiping means along said path throughout the wiping operation. There is also body-supporting means at opposite sides of the path of travel embodying yieldable pads adapted to conform to the body of the bottle for holding the bottle upright as it travels along said path and the aforesaid neck-supporting means is attached to one of the body-supporting means. The labels are initially pressed against the near sides of the necks of the bottles with respect to the label-picking instrumentalities and the latter are designed to attach the labels tangentially to the near side of the bottle necks so that the planes of the tangentially attached labels are parallel to the direction of travel of the bottles. The neck-supporting means at the near side of the bottles not only support the bottles, but also hold the tangentially attached labels from lateral displacement during the wiping operation. The wiping means for deflecting the ends of the labels comprises a first jet arranged to displace the trailing end of the label transversely of the path of movement into the path of operation of the wiping means and the latter comprises a first rotary wiper for application of a wiping force to the trailing ends of the label forwardly with respect to the direction of travel and further along said direction of travel a second jet arranged to displace the leading end of the label transversely of the path of travel into the path of a second rotary wiper for applying a force to the leading end rearwardly with respect to the direction of travel. Optionally, the leading ends may first be wrapped about the necks followed by wrapping the trailing ends about the necks. The rotary wipers comprise brushes arranged to travel in arcs about centers spaced from the path of travel along the path of travel in the direction of travel and about their own axes, respectively, in counterclockwise and clockwise direction. Each wiper means embodies four rotary wipers situated at equal peripheral and radial distances and each carries peripherally thereof a plurality of flexible, radially disposed brush elements of such length as to intercept the path of movement of the bottle as it travels arcuately along said path and each containing a gap between the circumferentially arranged brush elements to receive the transversely jettisoned ends of the labels so that the leading and trailing brush elements will apply forward and rearward wiping forces or vice-versa to the label ends.

Optionally, the aforesaid wrapping means may be arranged to wrap the leading ends of the labels about the forward sides of the bottle neck first and the trailing ends thereafter so that the terminal ends of the trailing ends of the labels overlap the terminal ends of the leading ends. It is also within the scope of the invention to wrap the ends of the labels into abutting relation rather than overlapping relation.

The invention will now be described in greater detail with reference to the accompanying drawings, wherein.

Figure 2:
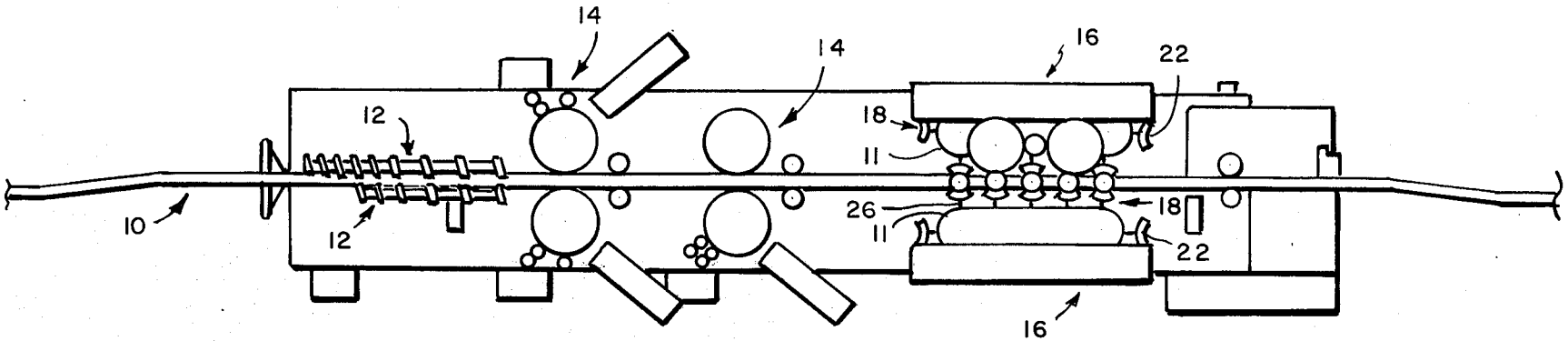
FIG. 2 is a plan view of FIG. 1.
Figure 2A:
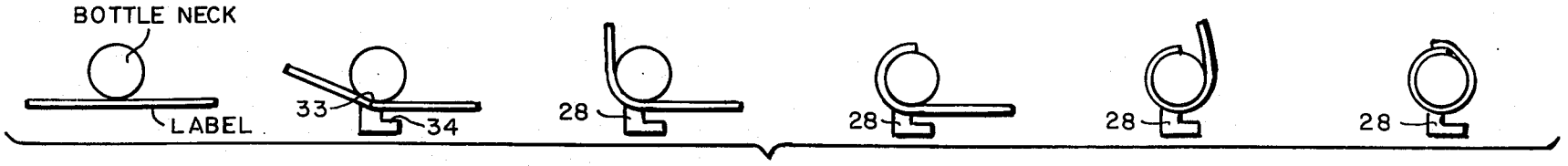
Figure 3:
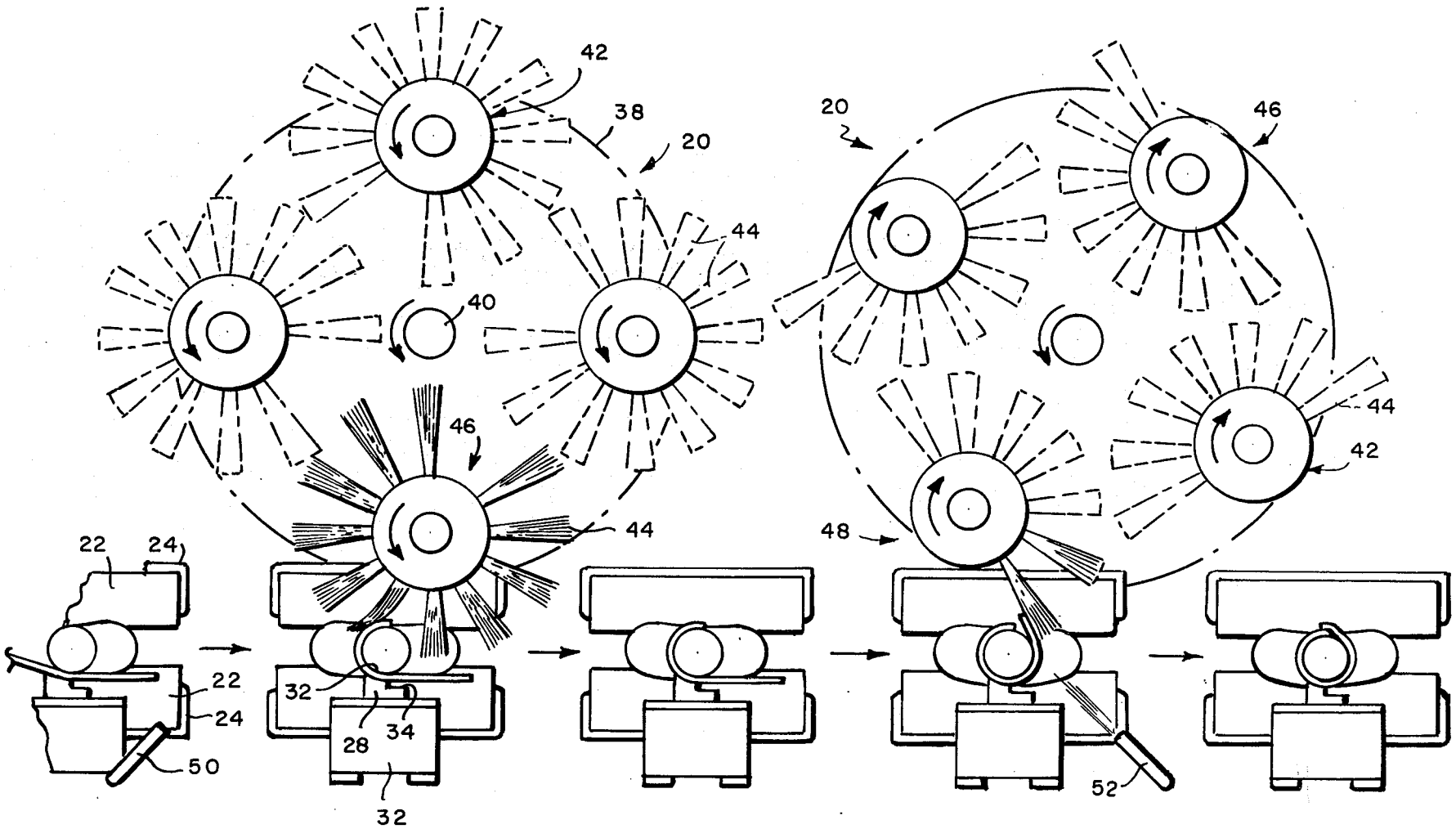
Figure 3A:
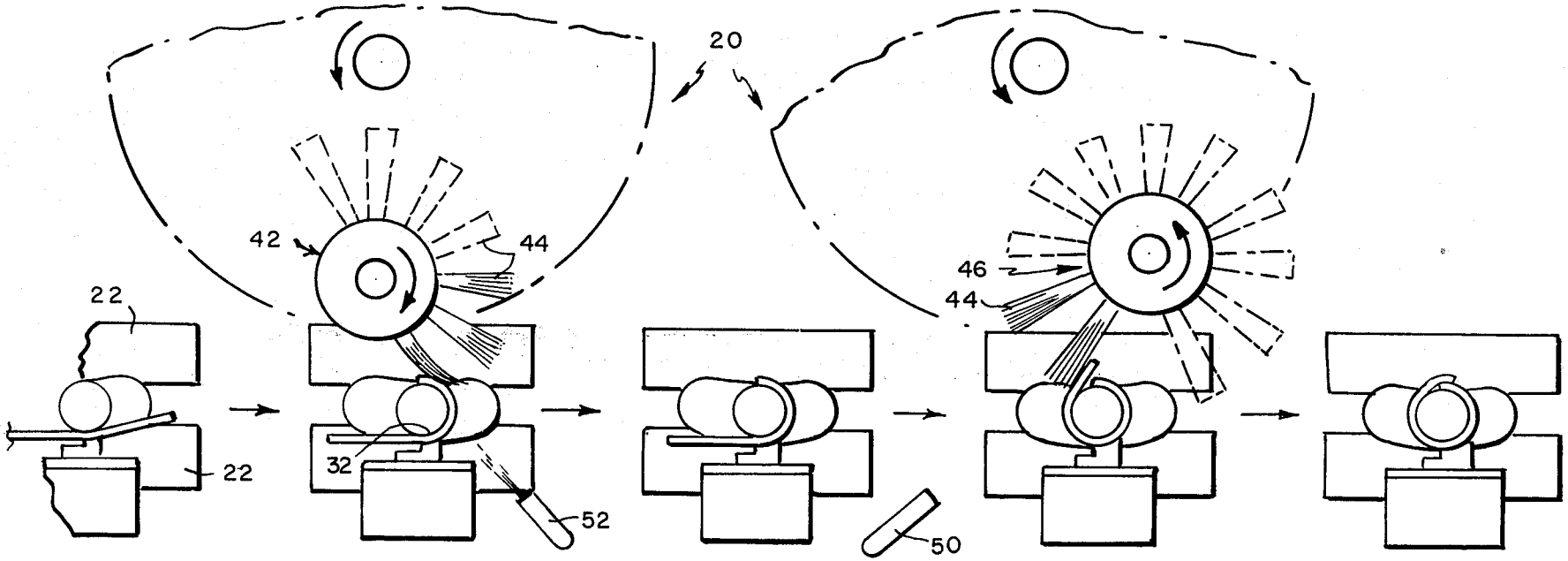
Figure 4:
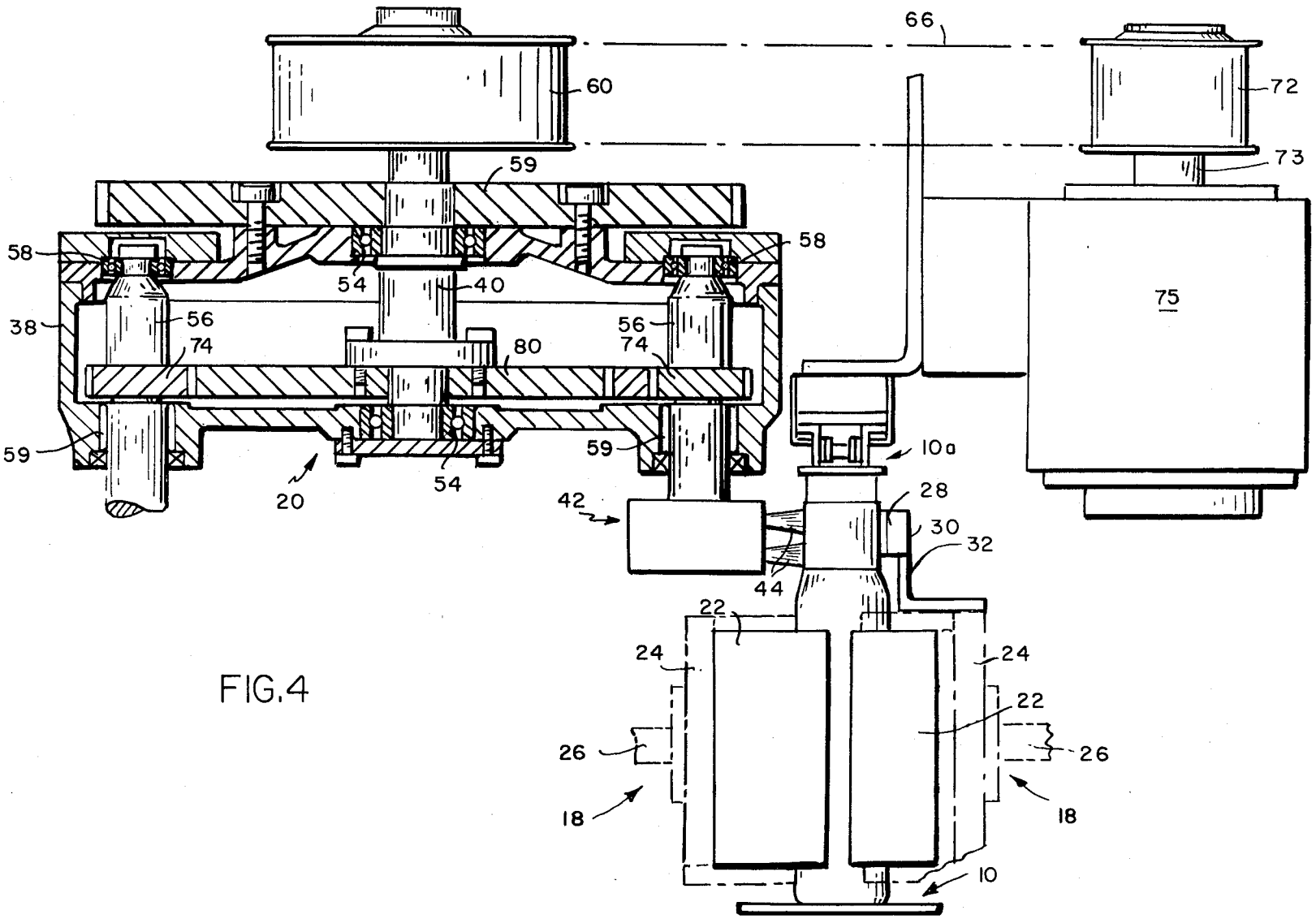
Figure 5:
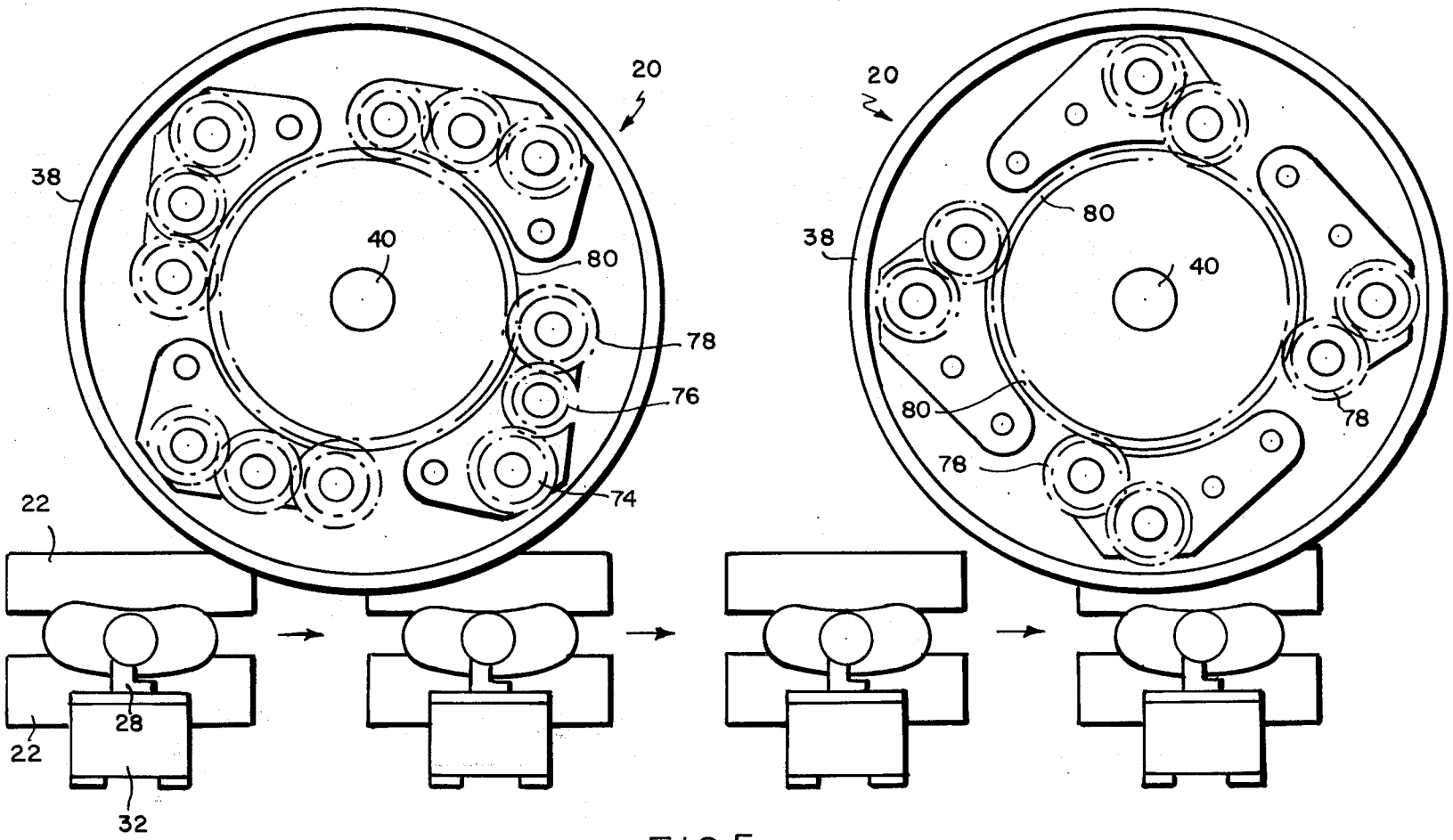
Figure 6:
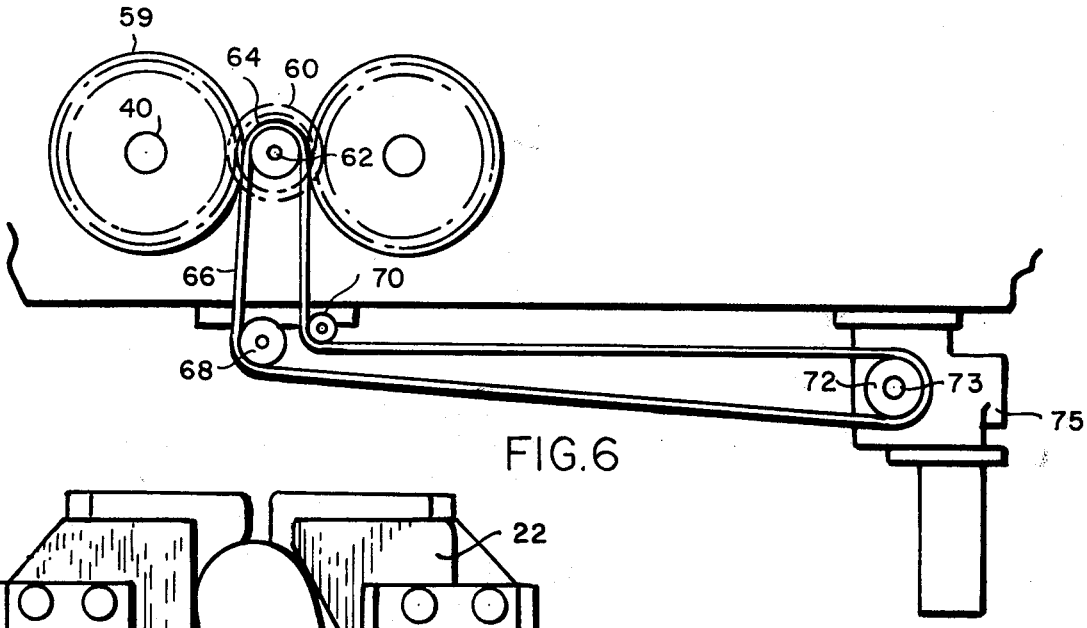
Figure 13:
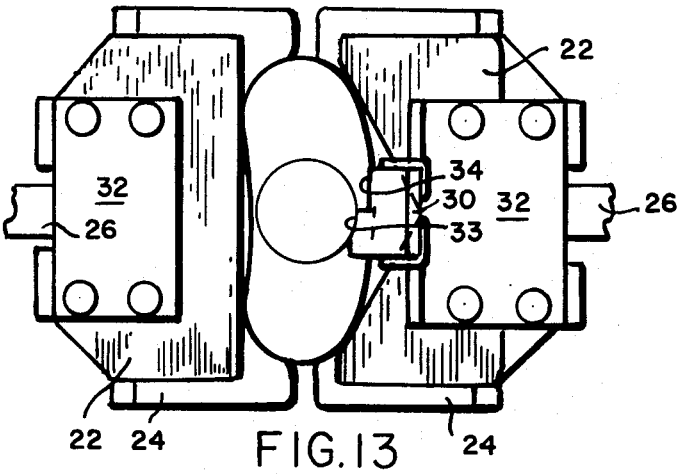
Figure 14:
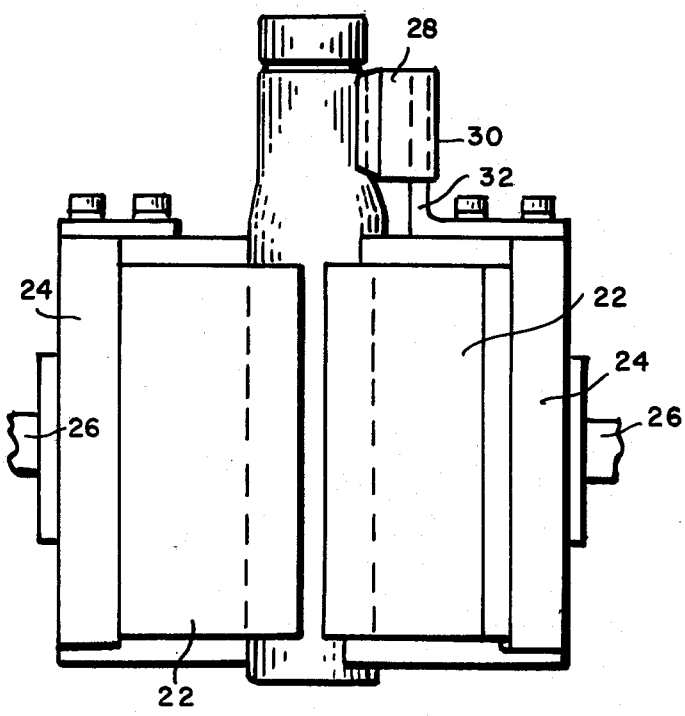
Figure 7:
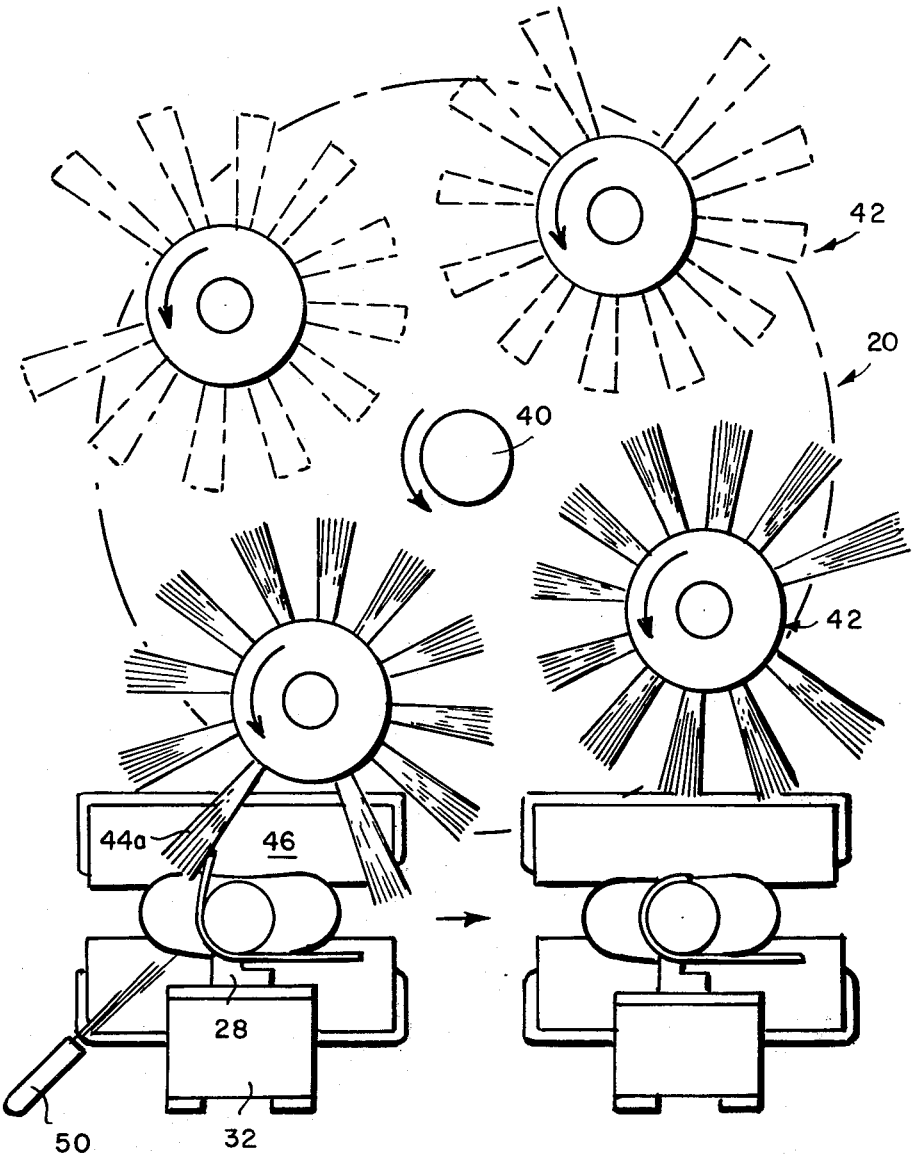
Figure 8:
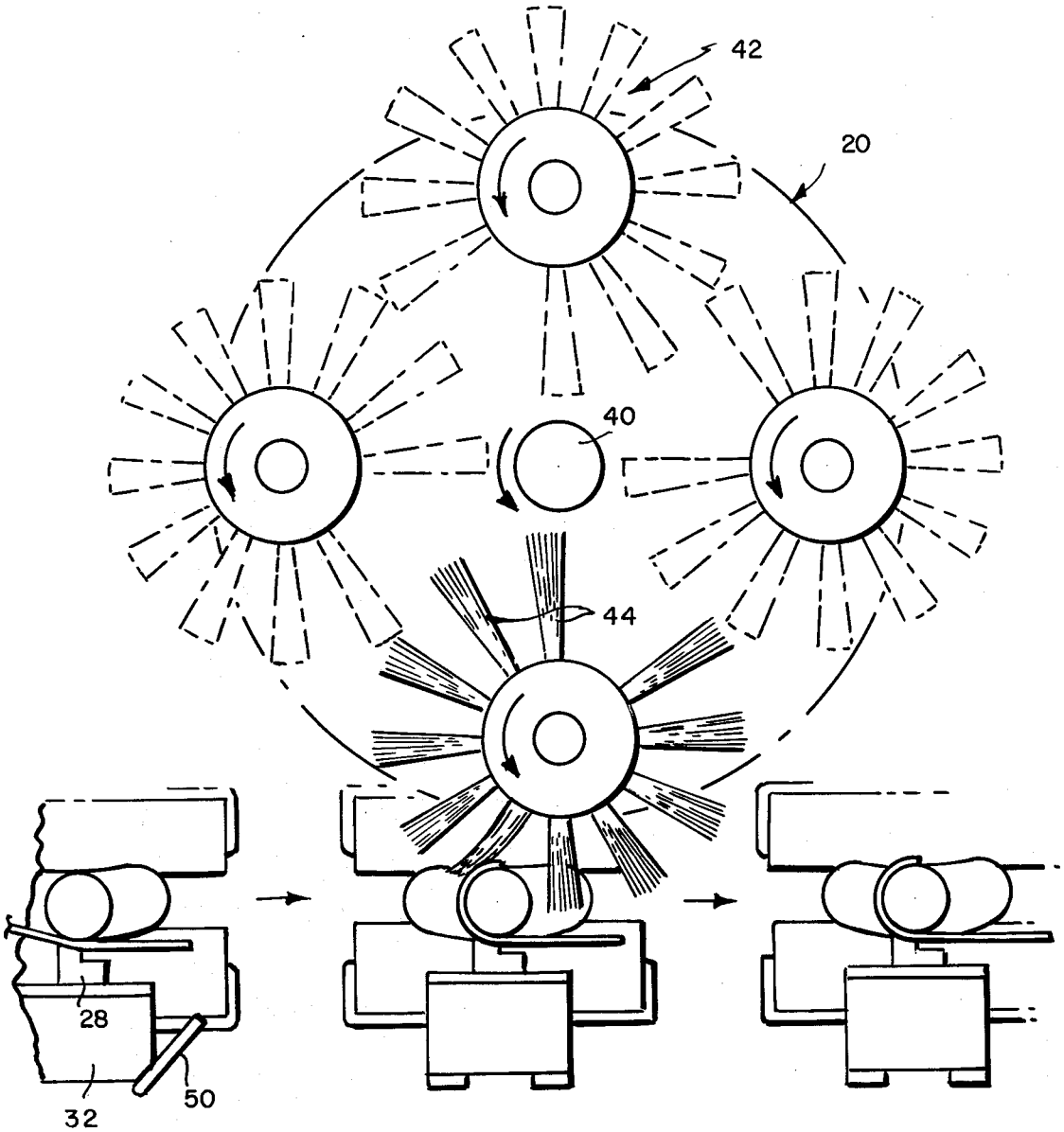
Figure 9:
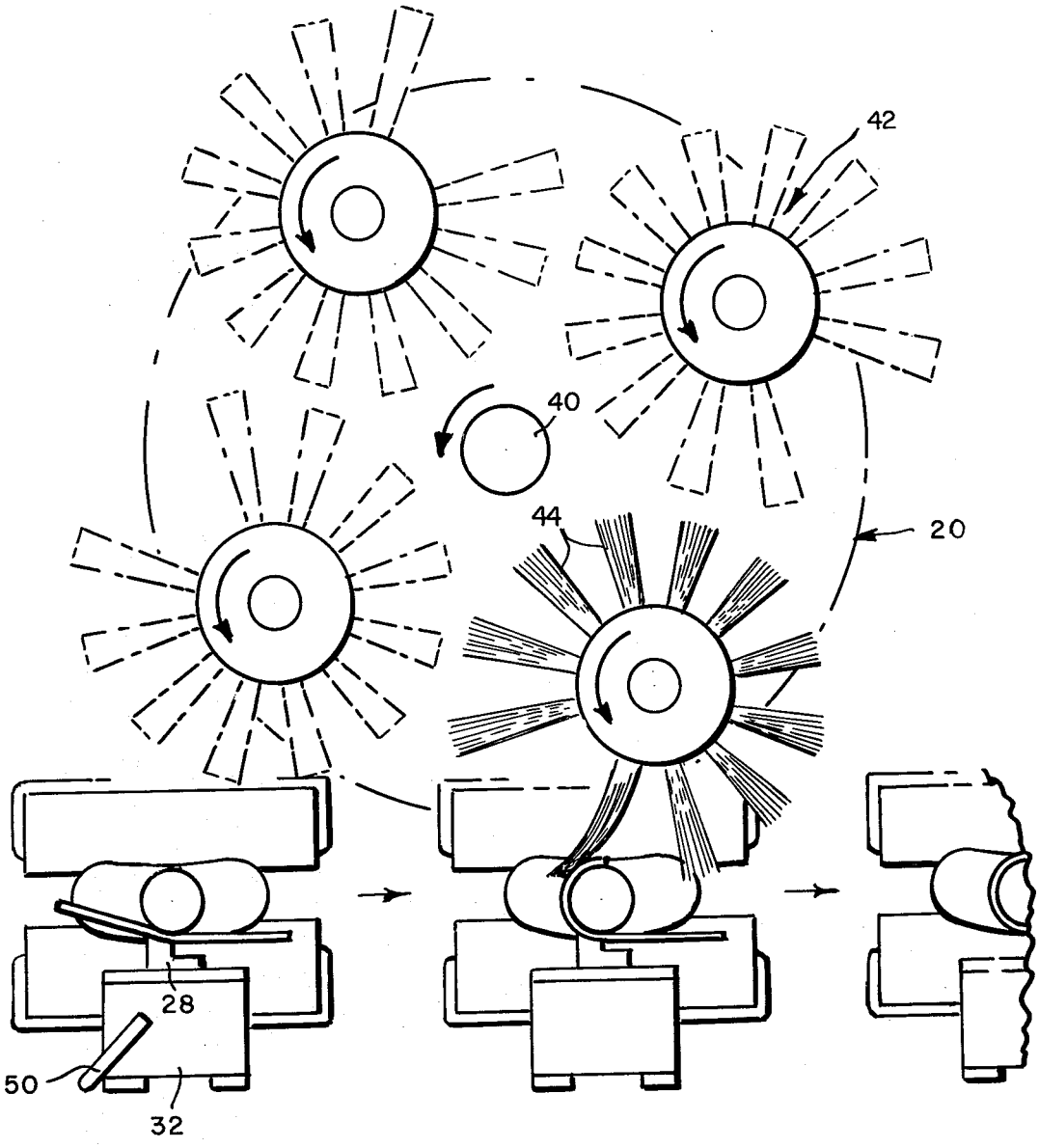
Figure 10:
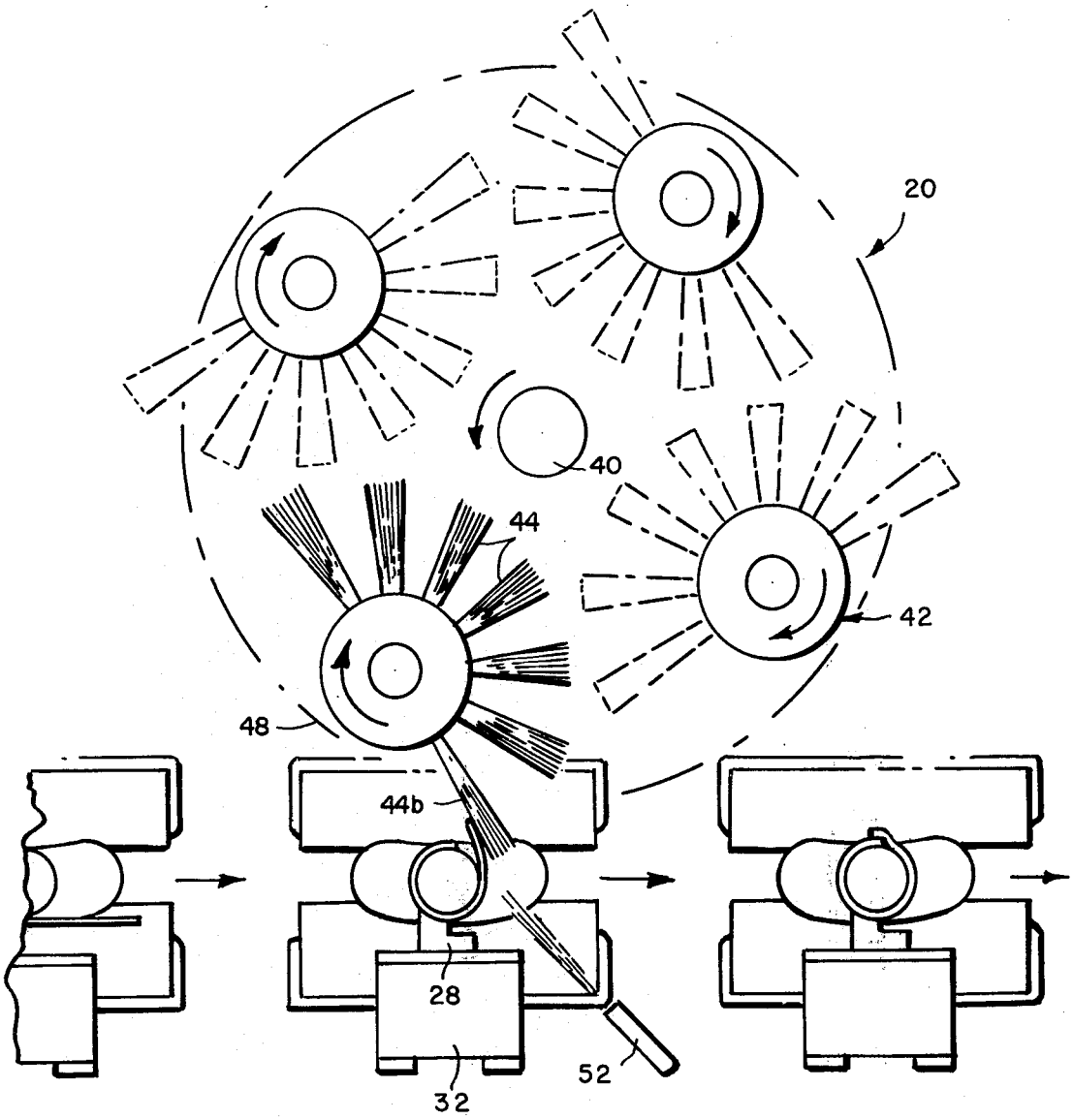
Figure 11:
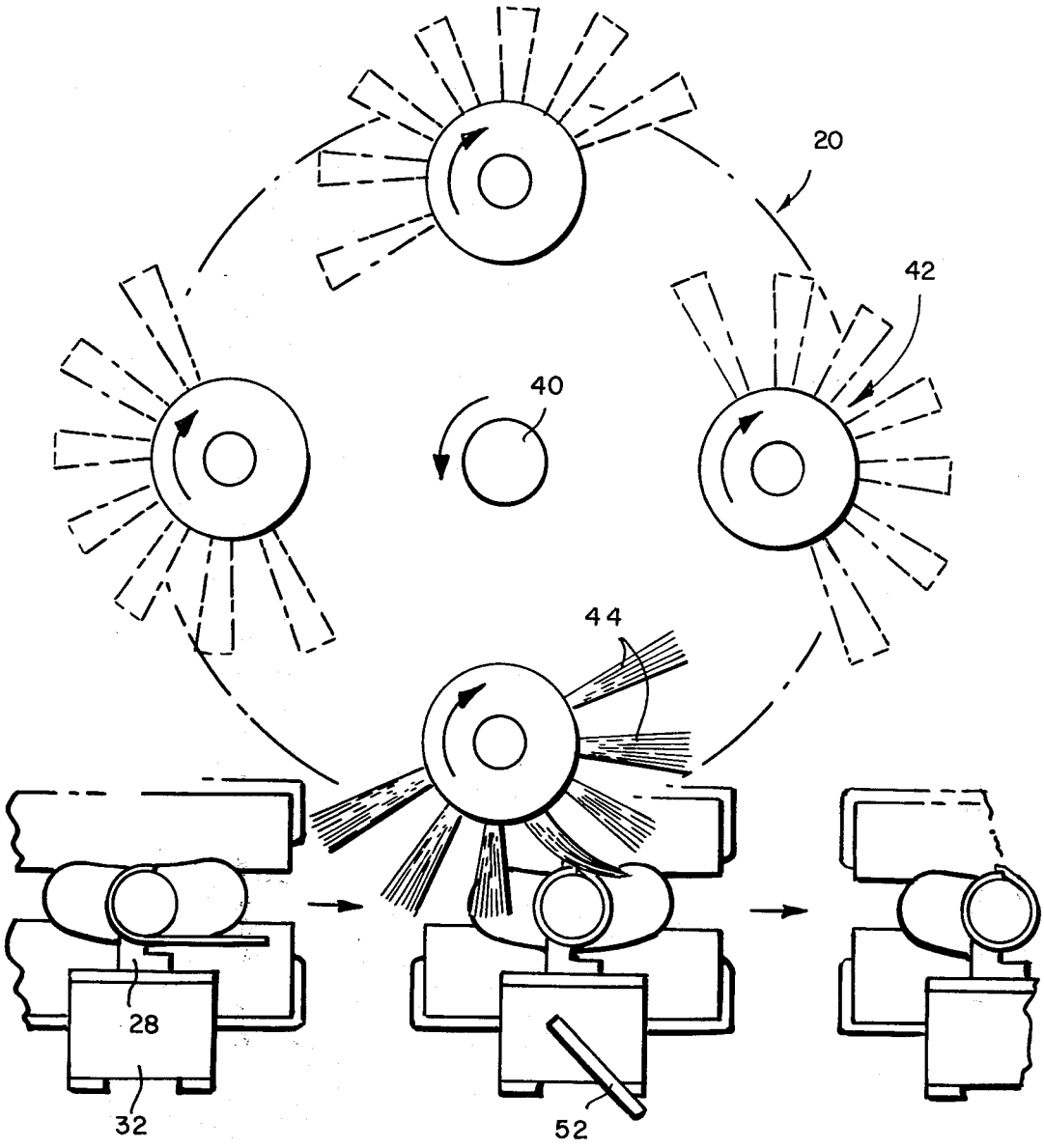
Figure 12:
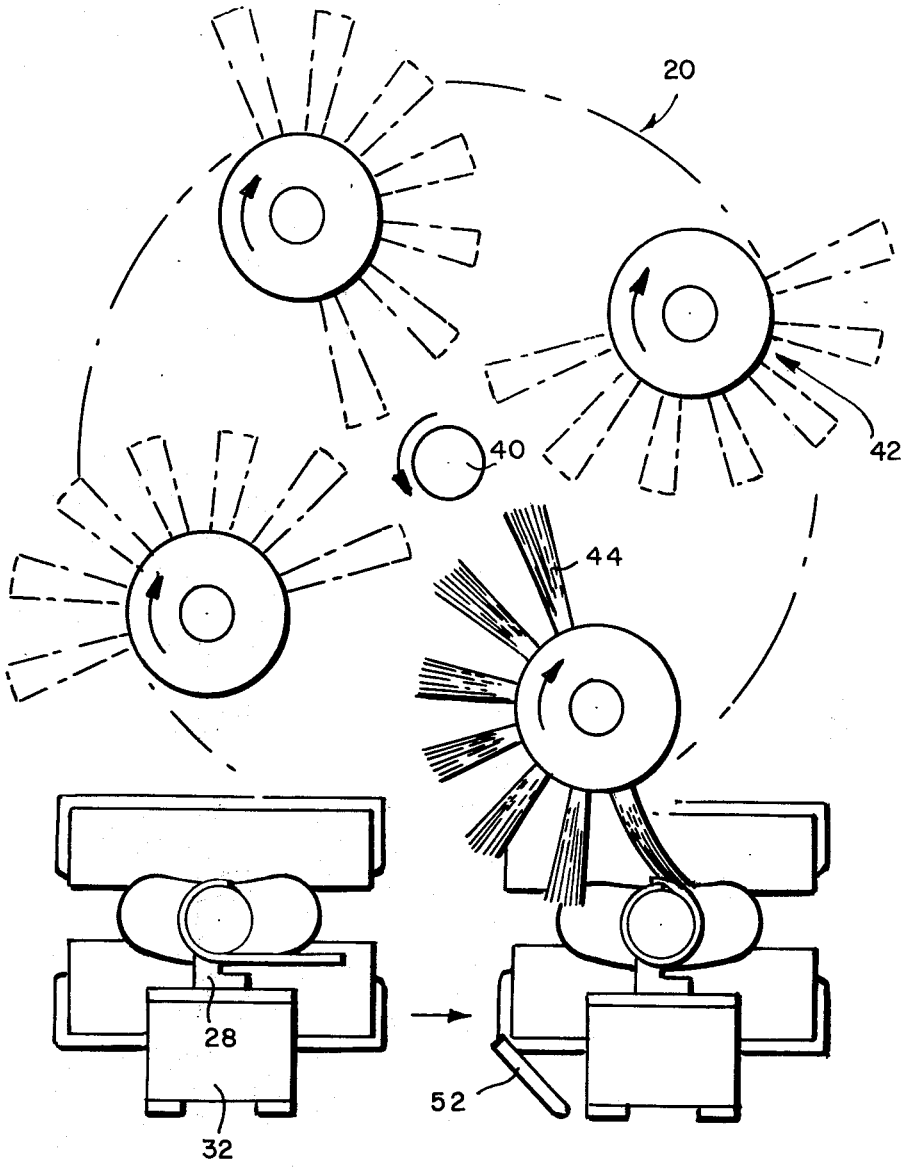

FIG. 2A diagrammatically shows the successive steps of wrapping a label about the neck of a bottle;

FIG. 3 is a plan view to much larger scale showing the relation of the wiping instrumentalities to the traveling line of bottles wherein the trailing end is first wrapped about the neck followed by the leading end;

FIG. 3A is a plan view similar to FIG. 3 to smaller scale showing an arrangement of the wrapping means for wrapping the leading ends of the labels about the necks and thereafter wrapping the trailing ends about the necks;

FIG. 4 is a transverse section of the wiper drive showing parts in elevation;

FIG. 5 is a plan view of the drive for the wiping instrumentalities;

FIG. 6 is a plan view of the drive from the main drive shaft of the labeler to the drive for the wiping instrumentalities;

FIGS. 7, 8 and 9 are plan views of the wiping instrumentalities showing the successive operations of wiping the trailing end of a label about the rear side of a bottle neck and onto the far side;

FIGS. 10, 11 and 12 are plan views of the wiping instrumentalities showing the successive operations of wrapping the leading end of the label about the forward side of the bottle neck and onto the far side in overlapping relation to the terminal end of the trailing end of the label;

FIG. 13 is a plan view of the bottle clamping means for holding the bottles during application of the labels thereto; and FIG. 14 is an elevation of FIG. 13 showing the bottle clamping means and label clamping means for preventing displacement of the label while the ends of the latter are being wrapped about the neck of the bottle.

Figure 1:
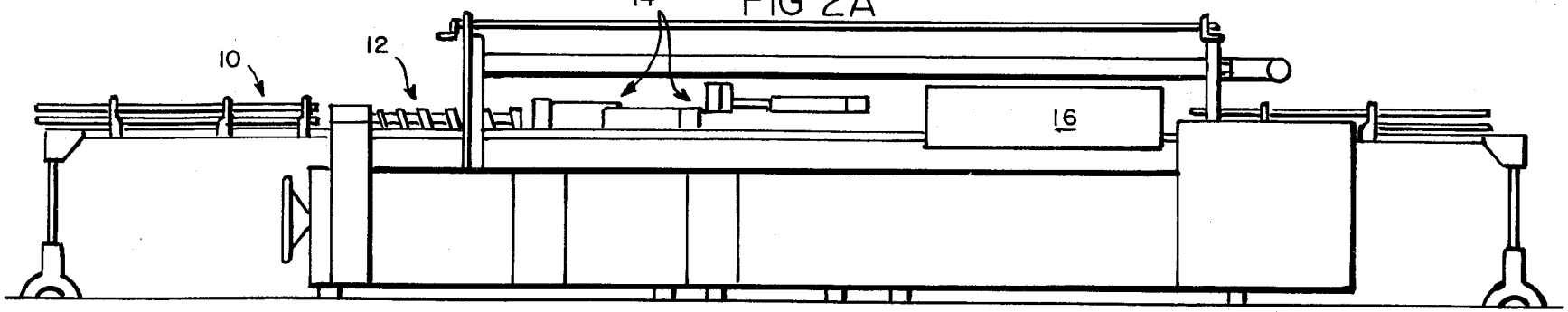
FIG. 1 is an elevation of labeling apparatus embodying the label applying and wiping instrumentalities of this invention.

Referring to FIGS. 1 and 2, the labeling machine embodying the invention as herein illustrated is of the kind wherein containers in the form of bottles standing upright are advanced by a conveyor 10 to a pair of helical spacing screws 12—12, from thence to means 14—14 for pressing labels to the bodies and necks of the containers and from thence to wiping instrumentalities 16—16 which wipe the body labels and the neck labels, whereupon the completely labeled bottles are discharged by the conveyor 10. The bottles are held down on the conveyor during travel by a hold-down chain 10*a*, FIG. 4, spaced above and parallel to the conveyor of the kind shown in my U.S. Pat. No. 3,012,650. The means 14—14 for preliminarily applying the labels are turrets located at opposite sides of conveyor 10 to which labels are supplied by pickers and adhesively coated by adhesive applying means as shown in my U.S. Pat. No. 3,806,114. The labels applied by the aforesaid means are pressed tangentially against the surfaces of the bottle necks and as the bottles with the labels tangentially attached thereto travel toward the wiping means, the labels travel parallel to the direction of travel of the bottles to which they have been pressed.

The wiping instrumentalities 16—16 comprise body label wiping means 18—18 of the kind shown in my U.S. Pat. No. 3,954,549 and neck label wiping means 20, FIG. 4, which is the subject matter of this invention.

As disclosed in the aforesaid patents, the body labeling means 18—18 are designed to move the bottles along a predetermined path for a sufficient length of time to permit the body labeling pads to be brought into engagement with the labels and hold them pressed against the sides of the bottles until they become sufficiently adhesively attached thereto so that when the pads are removed, the labels will remain stuck to the sides of the bottle. The neck labeling means 20 of this invention is designed to apply the neck labels to the necks of the bottles within this same or substantially the same distance.

The body wiping means for applying labels to the bodies of the bottles to one or both sides comprises a plurality of transversely spaced pads 22—22, FIGS. 2, 4, 13 and 14, of a yieldable material such as blocks of sponge rubber fixed within shoes 24—24, the latter being connected by arms 26—26, FIGS. 4 and 14, to the runs of chains 11—11, FIG. 2, as disclosed in the aforesaid patents. As the pads 22—22 at opposite sides of the path of travel come together, they clamp the bodies of the bottles between them, yielding to the shape of the body and move them rectilinearly along the path of travel, holding them at a predetermined spacing and holding them upright during the pressing of the label or labels to their sides and necks.

The neck labels are generally applied only to one side of the neck and to support the bottle rigidly during the application of the neck label, the body wiping means at one side, as shown in FIGS. 2A, 3, 4, 13 and 14, is provided with a supporting block 28 of yieldable material fixed in a shoe 30, FIGS. 4, 13 and 14, mounted by means of a bracket 32 to the upper end of the shoe 24. The neck supporting block 28 is mounted to the body supporting shoe 24 at the same side as the label pressing instrumentalities so as to counteract the force applied to the opposite side by the wiping means. The neck-supporting block 28 has an additional function, that of preventing the label from slipping forwardly or rearwardly during the wiping operation.

The neck-supporting block 28, as shown in FIGS. 2A and 13 is provided on its face with an arcuate surface 33 for engagement with the arcuate portion of the neck at the near side from the point of tangency of the block with the neck rearwardly approximately an eighth of the distance around the neck of the bottle in a rearward direction and with an offset surface 34 spaced from and parallel to the line of tangency sufficiently to clear the forwardly projecting leading end of the label. The arcuate portion 33 of the block initiates bending of the label around the rear side of the neck of the bottle, whereas the flat portion 34 of the block preserves the forwardly extending plane of the label.

The neck wrapping means comprise jets arranged along one side of the path of travel for deflecting the trailing and leading ends of the tangentially attached label transversely of the path of movement and wipers at the other side for wiping the transversely displaced ends about the far side of the neck.

The jets, of which there are two, 50 and 52, FIGS. 3 and 7 to 12, are arranged at the same side as the blocks 28 at angles of approximately 45° to the path of travel, the nozzle 50 being positioned to deflect the trailing end of the label just before the wiping means moves into operative position with respect thereto and the nozzle 52 being positioned to deflect the leading end of the label just before the second wiping means moves into operative position.

The wipers 20, FIG. 3, are mounted along one side of the path of travel of the bottles above the body wiping assemblies on a suitable support in longitudinally spaced relation so that the first of the wiper assemblies operates to wipe the trailing end of the label about the neck of the bottle and the second operates to wipe the leading end of the label about the neck of the bottle. Each assembly comprises a rotary support 38, FIG. 4, mounted on a shaft 40, the axis of which is spaced from the conveyor for rotation about the axis of the shaft and, on each rotary support 38, there are four rotary wipers 42 arranged at equal peripheral distances from each other and at equal radial distances from the axis of the shaft 40 so that the wipers are moved arcuately about the axis of the shaft 40 toward and away from the path of travel of the bottles on the conveyor as the rotary support turns on the shaft 40. As will be described hereinafter, the rotary support 38 of the first of the wiper assemblies, FIG. 3, rotates in a counterclockwise direction so that the wipers travel arcuately in the direction of movement of the conveyor and, during their arcuate movement, the wipers are rotated about their axis in counterclockwise directions.

The second of the wiper assemblies, FIG. 3, like the first, comprises a rotary support 38 and rotary wipers 42 and, like the first, the rotary support rotates in a counterclockwise direction, but, unlike the first, the wipers rotate in clockwise directions.

Each of the rotary wipers 42 has mounted to it a plurality of radially extending brush elements 44 arranged peripherally around its center of rotation. These brush elements, as illustrated in FIG. 3, are of varying radial length so that throughout the arcuate movement of a wiper as it approaches and leaves the path of travel of the containers, the engagement of the brush elements with the neck of the bottle will be prolonged as long as possible. The brush elements are located so that when the wiper is closest to the path of travel of the bottles, the shorter brush elements will be in a position for wiping and as it approaches and recedes from the path of movement, the longer brush elements will be in brushing engagement with the neck.

Each of the rotary wipers of the first wiping assembly, as also shown in FIG. 3, contains at one place in the periphery a gap 46 between brush elements which is greater than that between the remaining brush elements which is provided for by leaving out one brush element. The rotary wipers in the second wiping assembly are provided with much wider gaps 48 by leaving out approximately five brush elements.

In operation, as a bottle travels toward the first wiping assembly with the label pressed against its near side as shown in FIG. 2A in tangential engagement with the neck of the bottle and with the end portions in a plane substantially parallel to the direction of movement, the trailing portion of the label is displaced from the plane parallel to the direction of travel transversely of the path of movement into the path of rotation of the brush elements of the rotary wiper by a jet of air which is projected at an angle to the path of travel of the bottles from a nozzle element 50, FIG. 7, the operation of which is timed with the rotation of the rotary wiper so that the jet strikes the trailing end of the label at substantially the moment that the gap 46 between the brush elements arrives at a position opposite the neck of the bottle so as to blow the trailing end of the label into the gap in a position to be engaged with the brush element 44*a*, FIG. 7, which is at the trailing side of the gap with respect to the direction of rotation. As the rotary wiper continues to rotate and the bottle continues to travel, the trailing end of the label is wiped all the way around the trailing side of the bottle neck with respect to the direction of movement of the bottle to the far side of the neck. FIGS. 7 to 9 show the arcuate movement of the wiper while in wiping engagement with the neck. During this wiping operation, the leading end of the label remains parallel to the direction of travel lying outside of the sphere of operation of the first in line of the wiper assemblies. As the bottle travels onwardly to the second wiper assembly with the leading end of the label parallel to the direction of movement, the second jet of air projected from a nozzle 52 strikes the leading end of the label, FIG. 10, and displaces it transversely of the path of movement into the gap 48 into the path of movement of the brush element 44*b*. As before, the timing of the jet and the rotation of the rotary wiper is such as to insure displacement of the leading end of the label into the gap before the brush element 44*b* moves into operative position.

As previously indicated, there are four rotary wipers 42 in each wiper assembly and these are so spaced peripherally of the wiper support in relation to the rotation of the wiper support and the rate of travel of the bottles along the conveyor that the wiping operation on successive bottles is effected by rotary wipers.

As previously related, the rotary support 38 is mounted for rotation on a shaft 40 and referring to FIG. 4, the support 38 is mounted for free rotation about the axis of the shaft 40 on vertically spaced bearings 54—54 and, in turn, rotatively supports shafts 56 in vertically spaced bearings 58, 59. The rotary wipers 42 are fixed to the lower ends of the shafts 56. A large gear 59, the center of which is concentric with the axis of the shaft 40, is bolted to the top side of the rotary support 38 and the two gears 59 of the respective assemblies mesh with a common drive gear 60, FIG. 6. The drive gear 60 is fixed to a shaft 62 to which there is fixed a pulley 64. A belt 66 is provided for driving the shaft 62 and, to this end, is entrained about the pulley 64, a pair of guide pulleys 68 and 70 and a drive pulley 72 mounted to the output shaft 73 of a gear reduction unit 75, the output to which is connected to the main drive shaft of the labeler. The gear reducer 75 is connected to the main drive of the machine so that the rotary supports 38 are driven continuously during operation of the labeler at a speed such that the rotary wipers are moved successively into operative relation with the bottles moving along on the conveyor.

Each of the shafts 56 has fixed to it a gear 74. The gears 74 of the several shafts 56 of the first wiper assembly are driven by a train of gears comprising gears 76, 78 and 80, FIG. 5, the latter being fastened to the rotary support 30 in concentric relation to the axis of the shaft 40 for rotation about the shaft 40. The gears 76 and 78 are rotatably mounted on the rotary support 38 so that, as the rotary support 38 turns counterclockwise around the shaft 40, the shafts 56 are rotated counterclockwise around their axes.

The second of the wiper assemblies is like that just described with the exception that the train of gears which drive the wiper shafts comprises only the gears 78 and 80, FIG. 5, the gear 76 being omitted so that the rotary support rotates in a counterclockwise direction and the rotary wipers rotate in clockwise directions.

As thus constructed, in operation, as the bottles are moved along relative to the wiper assemblies, each bottle is subjected to a relatively prolonged wiping operation as it travels along said path, thereby assuring a firm adherence of the label ends to the bottle neck so that the bottles can be moved at an extremely high rate of speed with the assurance that the wiping engagement of the wipers with the bottles will be sufficiently long to insure adherence. With an arrangement such as described, the rate of movement of the bottles with an assurance that the labels can be securely applied can be as high as 450 to 600 bottles per minute.

As described above, the trailing ends of the labels are first wiped around the necks of the bottles, followed by wiping the leading ends. However, it is within the scope of the invention to wipe the leading ends around the necks first and thereafter wipe the trailing ends about the necks. This is accomplished by mounting the deflecting nozzles 50, 52 at opposite angles as shown in FIG. 3A and by rotating the wipers 42 in the first wiping assembly counterclockwise and rotating the wipers 42 of the second assembly clockwise. The neck-supporting blocks 24 are also altered so that the arcuate surfaces 32 engage the forward sides of the necks and the straight portions extend rearwardly therefrom.

The neck wiping assemblies disclosed herein and as described are for the purpose of applying neck labels around the entire cylindrical surfaces of the necks to bring their ends into overlapping relation. However, it is considered to be within the scope of the invention to use the same kind of wiping structure for wrapping labels around the body of a bottle of cylindrical or generally cylindrical configuration if it were desired to apply labels to the entire peripheral surface of the bottle body.

It should be understood that the present disclosure is for the purpose of illustration only and includes all modifications or improvements which fall within the scope of the appended claims.

I claim:

1. Apparatus for applying labels to bottle necks comprising a conveyor defining a support for moving bottles continuously rectilinearly along a horizontal path, means located at one side of the conveyor for pressing a label into tangential engagement with the neck of a bottle traveling along said path, and wiping means beyond the place where the label is pressed into tangential engagement with the neck for successively wrapping first one end portion and then the other end portion of the label about the neck, said latter means comprising at the other side of the conveyor a stationary support spaced from the conveyor, longitudinally spaced rotors fixedly mounted on the stationary support for turning about longitudinally spaced axes perpendicular to the path of movement of the conveyor and spaced therefrom, rotary wipers mounted at equal peripheral distances about the rotors for rotation about axes spaced from and parallel to the axes of the rotors, means for rotating the rotors in a direction such that as the wipers travel around the axes of the rotors, they approach and leave the path of movement of the conveyor means along circular paths in the direction of travel of the conveyor, means on the rotary wipers which extend from the wipers into the path of movement of the conveyor, and means for rotating the rotary wipers on the respective rotors in opposite directions.

2. Apparatus according to claim 1 for applying a label to the neck of a bottle so as to lap the terminal end of the leading end of the label over the terminal end of the trailing end of the label.

3. Apparatus according to claim 1 comprising means at the one side of the path of travel of the bottles movable along said path in engagement with the necks of the bottles at said side to hold the labels to the necks during the wrapping of the ends.

4. Apparatus according to claim 1 comprising means at the place of wrapping for gripping and supporting a bottle upright as it travels along said path.

5. Apparatus according to claim 1 wherein said means at the one side of the path of travel further comprises jets spaced longitudinally of the path of travel operable successively to deflect the trailing and leading ends of the label transversely across the path of movement about the rear and forward sides of the bottle into the path of the wiping means.

6. Apparatus according to claim 5 comprising means supporting the jets at fixed positions along the path at angles forwardly and rearwardly with respect to the direction of travel of the bottles.

7. Apparatus according to claim 1 comprising clamping means at opposite sides of the path of travel for engagement with the body of the bottle as it is moved along said path to hold the bottle upright during the wrapping operation.

8. Apparatus according to claim 1 wherein said rotors have peripherally thereof rotary wiping means containing gaps and said means at the one side of the path of travel further containing the means for deflecting the trailing and leading ends of the labels transversely of the path of travel into the gaps just before the wiping means at the trailing sides of the gaps move into engagement with the deflected ends.

9. Apparatus according to claim 1 wherein said wiping means are spaced peripherally of the rotors and comprise flexible bristles.

* * * * *